US005338475A

United States Patent [19]

Corey et al.

[11] Patent Number: 5,338,475

[45] Date of Patent: Aug. 16, 1994

[54] CARPET CLEANING COMPOSITION WITH BLEACH

[75] Inventors: Garland P. Corey, Milltown, N.J.; Elmer M. King, Albaquerque, N. Mex.; Ralph E. Rypkema, Lodi, N.J.

[73] Assignee: Sterling Drug, Inc., New York, N.Y.

[21] Appl. No.: 745,782

[22] Filed: Aug. 16, 1991

[51] Int. Cl.[5] ..... C11D 3/24; C11D 3/39; C11D 3/395; C11D 3/43

[52] U.S. Cl. ..... 252/102; 8/111; 8/137; 252/89.1; 252/95; 252/100; 252/104; 252/142; 252/143; 252/174.16; 252/545; 252/DIG. 14; 427/393.4

[58] Field of Search ..... 252/94, 95, 98, 97, 252/99, 100, 102, 104

[56] References Cited

U.S. PATENT DOCUMENTS

| | | | |
|---|---|---|---|
| 3,607,760 | 9/1971 | McIntyre | 252/102 |
| 3,748,268 | 7/1973 | Loudas | 252/90 |
| 3,775,052 | 11/1973 | Van Paassen | 8/137 |
| 3,835,071 | 9/1974 | Allen et al. | 252/545 |
| 3,994,744 | 11/1976 | Anderle et al. | 134/4 |
| 4,124,542 | 11/1978 | Devine | 252/546 |
| 4,238,192 | 12/1980 | Kandathil | 8/111 |
| 4,395,347 | 7/1983 | McLaughlin et al. | 252/139 |
| 4,490,270 | 12/1984 | Hackett | 252/100 |
| 4,552,692 | 11/1985 | Gillespie | 252/528 |
| 4,557,898 | 12/1985 | Greene | 422/28 |
| 4,566,980 | 1/1986 | Smith | 252/8.6 |
| 5,002,684 | 3/1991 | Beck et al. | 252/105 |
| 5,106,523 | 4/1992 | Peterson | 252/95 |
| 5,118,436 | 6/1992 | Aoyagi | 252/99 |

FOREIGN PATENT DOCUMENTS

| | | |
|---|---|---|
| 42875/89 | 5/1990 | Australia . |

*Primary Examiner*—Dennis Albrecht
*Attorney, Agent, or Firm*—John R. Everett

[57] ABSTRACT

A carpet cleaning composition is disclosed. The composition contains, on a weight-to-weight basis, a. about 0.30 to 2.2 percent of hydrogen peroxide;

b. from about 0.05 to about 5.0 percent of a nonionic, anionic or amphoteric surfactant or mixture thereof; and c. a pH in the range above 3.5 and below 6.4.

7 Claims, No Drawings

CARPET CLEANING COMPOSITION WITH BLEACH

FIELD OF THE INVENTION

The invention relates to carpet cleaning compositions.

BACKGROUND OF THE INVENTION

Carpet cleaning compositions generally incorporate as the primary cleaning agent one or more detergents selected from soaps and surfactants. In some cases such compositions include one or more ingredients which function to impart to the carpet fibers beneficial properties such as antistatic, soil-, water- and oil-repellent properties. In cleaning carpets, many types of stains are encountered. Many of these stains cannot be removed by conventional carpet cleaners, especially so called oxidizable stains, without excessive scrubbing. Oxidizable stains are difficult to remove because an oxidizing agent may, potentially, cause adverse effects to a carpet's surface composition. Also oxidizing agents inherently lack stability, which is necessary for adequate shelflife and performance of a carpet cleaner.

SUMMARY OF THE INVENTION

This invention provides an aqueous carpet cleaning composition comprising on a weight-to-weight basis:

a. about 0.30 to 2.2 percent of hydrogen peroxide;

b. from about 0.05 to about 5.0 percent of a nonionic, anionic or amphoteric surfactant or mixtures thereof; and c. a pH in the range above 3.5 and below 6.4.

Surprisingly, we have found by selected use of chemicals pertinent to this area and a careful delineation of the formulation's pH:

1. Excellent peroxide stability has been observed.
2. Improved cleaning efficiency, especially on stains, has been observed.
3. Surprisingly, experiments indicate the adverse bleaching effect on a carpet's dye/appearance is greatly reduced.

DETAILS OF THE INVENTION

The compositions of the invention in addition to cleaning spots, stains and ground-in dirt from a carpet can include additional components to provide a carpet with excellent protection against resoiling. This protection can be provided by a mixture of (i) α-[2-[(2-carboxyethyl)thiolethyl]-ω-fluoropoly(difluoromethylene) lithium salt of the general formula:

$$F(CF_2)_n—CH_2CH_2—S—CH_2CH_2—COOLi \quad (I)$$

wherein n is 6 to 12, and (ii) the diethanolamine salt of a perfluoroalkyl phosphate represented by the general formula:

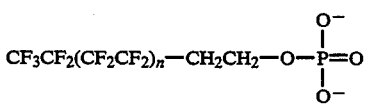

(II)

mono/bis-diethanolamine salt where n is 6 to 12.

The weight-ratio of the (i) perfluoropropionate of formula I to the (ii) perfluaroalkyl phosphate of formula II in the mixture is in the range of from about 1:1 to about 1:2. The amount of the mixture employed that may be employed in compositions of the invention is from about 0.07 to about 1.8% by weight, preferably from about 0.1 to about 0.5% by weight. Such mixture is manufactured by E. I. Du Pont de Nemours & Co., Inc. and sold under its trademark ZONYL 6885.

The composition of the invention contains from 0.05 to about 5.0 weight percent, preferably 0.1 to about 2.0 weight percent, of a nonionic, anionic or amphoteric surfactant or mixture thereof to provide cleaning and emulsifying properties thereto. Such surfactants are commercially available and a wide variety thereof may be employed, the only limitation being that the particular surfactant chosen, when employed in concentrations according to the invention, does not leave a tacky or oily residue on the carpet fibers. The selection of a suitable surfactant or mixture of surfactants to be employed in the composition of the invention is well within the skill of one versed in the carpet cleaner art.

Examples of nonionic surface active agents are:

(a) the polyethylene oxide condensates of alkyl and dialkyl phenols, having a straight or branched alkyl of from about 6 to about 12 carbon atoms, with ethylene oxide wherein the amount of ethylene oxide present is from about 3 to about 25 moles per mole of alkyl and dialkyl phenol; and the benzyl ether of such alkyl phenols.

(b) the condensation products of aliphatic alcohols with ethylene oxide of the formula $RO(C_2H_40)_nH$ wherein R is straight or branched alkyl having from about 8 to about 22 carbon atoms and n is 3 to 40; and (c) the primary, monoethanol- and diethanolamides of saturated and unsaturated fatty acids having an alkyl moiety of from about 8 to 22 carbon atoms.

Examples of anionic surface active agents are:

(a) soaps such as alkali metal and amine salts, e.g. an ethanolamine, saturated and unsaturated fatty acids having from about 8 to about 24 carbon atoms;

(b) alkyl sulfonates and sulfates wherein the alkyl is straight or branched and has from about 8 to about 24 carbon atoms and the cation is watersoluble, e.g., alkali metal and ammonium;

(c) sodium alkyl glyceryl ether sulfonates;

(d) alkyl ether sulfates of the formula $RO(C_2H_40-)_n—SO_3M$ wherein R is alkyl or alkenyl having from about 10 to about 20 carbon atoms, n is 1 to 30 and M is a water-soluble cation, e.g., alkali metal and ammonium;

(e) alkali metal and amine, e.g. an ethanolamine, salts of mono- and di-alkyl esters of sulfosuccinic acid where alkyl can be straight or branched and has from 7 to 30 carbon atoms;

(f) alkali metal salts of alkylbenzene and alkyl toluene sulfonic acids where alkyl has from about 9 to about 15 carbon atoms; and (g) alkali metal and amine salts of alkyl alkoxy carboxylic acids of the general formula:

$$RO(C_nH_{2n}O)_m—R_1COOM$$

where R is a straight or branched alkyl having from 8 to 18 carbon atoms, n is 2 to 41 m is 1 to 100; R1 is $CH_2$, $CH_2CH_2$ or $CH_2CH_2CH_2$; and M is a sodium, potassium, lithium, ammonium, diethylammonium or triethylammonium cation or other cation, including multivalent cations.

Examples of amphoteric surfactants are the aminocarboxylic and aminosulfonic acids and salts thereof such as alkali metal 3-(dodecylamino)propionate and alkali metal 3-(dodecylamino)propane-1-sulfonate; and alkyl and alkylamido betaines such as cocamidopropyl betaine.

It will be understood that the surfactants employed as cleaning and emulsifying agents in the compositions of the invention will be materials other than the fluorochemical anti-soiling con,Pounds described hereinabove which also have surfactant properties.

The compositions of the invention may include optional ingredients for performing specifically desired functions such as sequestrates, e.g., citric acid, sodium hexametaphosphate, tetrasodium ethylenediaminetetraacetate (Na4EDTA) and the like; organic liquid solvents for water-soluble stains, e.g., monohydric aliphatic alcohol having 1 to 6 carbon atoms such as ethyl alcohol, isopropyl alcohol and hexanol, glycols and glycol ethers such as 2methoxyethanol, propylene glycol monomethyl ether, 2butoxyethanol, 5-ethoxy-l-pentanol and the like; solvents for oily and greasy stains such as light aliphatic hydrocarbons and mixtures thereof such as mineral spirits (petroleum spirits) and hydrocarbons having from 5 to 19 carbon atoms, e.g., pentane, hexane, decane, tetradecane and nonadecane; preservatives such as formaldehyde (formalin), methyl- and ethylparaben, 1,2-benzoisothiazol-3(2H)-ones, etc.; tracers for aerosol dispensed formulations as a visual indicator of where the composition has been applied to the carpet, e.g., cetyl alcohol; and corrosion inhibitors such as citric acid, sodium citrate, sodium nitrite, ammonia, etc.

The compositions of the invention are formulated as aqueous solutions or emulsions and can be dispensed for use as liquids using conventional dispensing devices such as squeeze bottles fitted with a suitable dispensing nozzle or containers fitted with trigger spray pumps; or as an aerosol from conventional aerosol containers fitted with a suitable dispensing valve and button.

When the aqueous composition is to be dispensed from an aerosol container, the container will contain, in addition to the aqueous composition, an aerosol propellant or mixture of propellants sufficient to provide adequate pressure to dispense the solution on each actuation of the aerosol valve until substantially all of the composition eventually is exhausted. Propellants and propellant systems which can be employed are well known in the art. Typical of propellants which can be used are the low boiling chloro and fluoro substituted alkanes and low boiling aliphatic hydrocarbons such as propane/isobutane mixtures. In addition adequate corrosion inhibitors known to those skilled in the art can be employed especially with metal containers.

The pH of the aqueous composition of the invention should be in the range of from about 3.5 and below 6.4. While good carpet cleaning results are obtained throughout this pH range, the best results are obtained in the pH range of from about 5.8 to 6.4. When the composition includes mixtures of compositions according to aforementioned formulas I and II a pH of about 4.0 to about 7.0 is useful. However, when the aqueous composition is to be dispensed from an aerosol container of the type having tin-containing metallic components which will be exposed to the composition, e.g., tin-containing metallic inner walls, the composition should be in the alkaline pH range close to neutral since an acid pH can have deleterious effects on such metallic components. However, compositions having a pH in the acidic range can be dispensed from aerosol containers having substantially no exposed inner metallic components such as those having metallic inner walls which are coated with plastic material or suitably protected with known corrosion inhibitors.

If required, a pH adjusting agent is added to the composition in order to achieve a desired pH in the above-disclosed pH range, for example, citric acid, ammonia, Na4EDTA, NaOH and the like. The choice of a particular pH adjusting agent is well within the skill of the art.

The composition of the invention can be prepared by adding the essential ingredients, i.e., the surfactant, hydrogen peroxide and the fluorochemical anti-soiling mixture, in any order to water with agitation followed by any optional ingredients in any sequence. Conveniently the surfactant is first added to most of the calculated amount of water required, followed by the fluorochemical mixture and then any optional ingredients. The remainder of water is then added. When a pH adjuster is to be added; a sufficient amount thereof to achieve the desired pH is added just prior to adding the remainder of the water.

Carpets are cleaned by applying the composition, e.g., by spraying, to approximately 3 square feet of the carpet at a time at a rate of about 5 g/sq. ft., allowing about 1 to 3 minutes for the composition to penetrate the treated area and then rubbing the area with a suitable device, e.g., a clean damp cloth or sponge mop, with rinsing of the cloth or mop as needed, until no soil appears on the cloth or mop. The cleaned area then is allowed to dry. Under normal conditions of temperature and humidity the cleaned area will be substantially dry in about 15 to 20 minutes. Drying time will vary in humid weather and on shag and deep pile rugs. Vacuuming is not generally required. Optionally, when the composition is applied from an aerosol container, instead of mopping, cleaning may be completed by vacuuming the treated carpet after the carpet has dried.

The composition of the invention is illustrated by the following examples of specific formulations without, however, being limited thereto.

In the examples of the compositions, certain ingredients are identified by trademark or other designation, the components of which are as follows:

Teflon SC: 15.6% of a mixture of perfluoropropionates of formula I herein; 20–25% of a mixture of perfluoroalkyl phosphates of formula II herein (the perfluoroalkyl phosphate salt is obtained by neutralization of the corresponding acid with diethanolamine); 8–10% trichlorotrifluoro- ethane; 20–25% isopropyl alcohol—manufactured by E. I. Du Pont de Nemours Co., Inc.

Zonyl 6885; 10–15% of a mixture of perfluoropropionate of Formula I herein; 15–20% of a mixture of perfluoroalkyl phosphates of formula II herein (the perfluoroalkyl phosphate salts is obtained by neutralization of the corresponding acid with diethanolamine); 5–10% trichlorotrifluoroethane; 25–30% isopropyl alcohol; 35–40% water - manufactured by Du Pont de Nemours Co., Inc.

Sipex 108: Aqueous solution containing approx. 20.5% sodium lauryl sulfate and 4.5% disodium monolauryl sulfosuccinate available from Alcolac, Inc., Baltimore, Md. or Rone-Poulenc's Cyclory RS2S.

Akypogene KTS: 33% of a surfactant/polymer blend in water wherein the surfactant is laurylpolyglcolether carboxylic acid sodium salt of the general formula: $C_{12}H_{25}(OCH_2CH_2)XOCH_2COONa$ where x is 3 to 4—available from Alcolac, Inc., Baltimore, Md.

Monaterge 1164: 12% disodium monolauryl sulfosuccinate and 18% sodium lauryl sulfate in aqueous solution—available from Mona Industries, Inc., Paterson, N.J.

Sulfotex TO: 56–60% aqueous solution of ammonium myristyl py tri-ether sulfate of the formula $CH_3(CH_2)_{12}CH_2(OCH_2CH_2)_3$—0—$SO_3NH_4$—available from Henkel, Inc., Teaneck, N.J.

Triton CF-10: 100% octylphenoxypolyethoxyethyl benzyl ether (12 to 20 ethylene oxide units) in water—available from Rohm and Haas Company, Inc. Philadelphia, Pa.

Witcamide 511: 100% oleic diethanolamide—available from Witco Chemical Corporation.

Monateric 1000: 50% in water of sodium capryloamphopropionate of the formula $CH_3(CH_2)_6$-CO-$NHCH_2CH_2N(CH_2CH_20H)$ -$CH_2CH_2COONa$/corrosion inhibitor—available from Mona Industries, Inc., Paterson, N.J.

Monacor BE: 100% Monoethanolamine borate/-monoisopropanolamine borate mixture/corrosion inhibitor—available from Mona Industries, Inc.; Paterson, NJ.

Amsco Solv 1241: odorless mineral spirits/boiling range 346°–406° F.—available from Union Oil Company of California.

The examples on the following pages will illustrate the utility of the present invention.

TABLE I

FORMULATIONS TESTED

The formulations tested differ in use of cosmetic or regular grade hydrogen peroxide, inclusion of triethanolamine oleate and adjustment of pH to 5.8–6.4. Unadjusted the pH was 3.5–3.7. Amounts of each ingredient are on a weight basis.

| | Control | | | | | | | | | |
|---|---|---|---|---|---|---|---|---|---|---|
| Formulation | 1 | 2 | 3 | 4 | 5 | 6 | 7 | 8 | 9 | 10 |
| Weight & Ordorless Mineral Spirits | 2.5 | 2.5 | 2.5 | 2.5 | 2.5 | 2.5 | 2.5 | 2.5 | 2.5 | 2.5 |
| Oleic Acid | 0.2 | — | — | — | — | — | — | — | — | — |
| Sulfotex OT | 0.13 | 0.13 | 0.13 | 0.13 | 0.13 | 0.13 | 0.13 | 0.13 | 0.13 | 0.13 |
| Witcamide 511 | 0.4 | 0.4 | 0.4 | 0.4 | 0.4 | 0.4 | 0.4 | 0.4 | 0.4 | 0.4 |
| Fragrance (PFW SL-80-1547) | 0.86 | 0.86 | 0.86 | 0.86 | 0.86 | 0.86 | 0.86 | 0.86 | 0.86 | 0.86 |
| Na Hexameta-phosphate | 0.37 | 0.37 | 0.37 | 0.37 | 0.37 | 0.37 | 0.37 | 0.37 | 0.37 | 0.37 |
| Citric Acid | 0.13 | 0.13 | 0.13 | 0.13 | 0.13 | 0.13 | 0.13 | 0.13 | 0.13 | 0.13 |
| Triton CF-10 | 0.13 | 0.13 | 0.13 | 0.13 | 0.13 | 0.13 | 0.13 | 0.13 | 0.13 | 0.13 |
| Triethanol-amine | 0.2 | — | — | — | — | — | — | — | — | — |
| Formalin (37%) | 0.2 | 0.2 | 0.2 | 0.2 | 0.2 | 0.2 | 0.2 | 0.2 | 0.2 | 0.2 |
| Isopropyl alcohol | 1.27 | 1.27 | 1.27 | 1.27 | 1.27 | 1.27 | 1.27 | 1.27 | 1.27 | 1.27 |
| Hydrogen Peroxide | — | 2.0 | 1.0 | 0.5 | 2.0 | 1.0 | 0.5 | 2.0 | 1.0 | 0.5 |
| $H_2O$-deionized | qs-100 | qs-100 | qs-100 | qs-100 | qs-100 | qs-100 | qs-100 | qs-100 | qs-100 | qs-100 |
| | | pH adj. to 5.8–6.4 | pH adj. to 5.8–6.4 | pH adj. to 5.8–6.4 | pH adj. to 5.8–6.4 | pH adj. to 5.8–6.4 | pH adj. to 5.8–6.4 | pH adj. to 5.8–6.4 | pH unadj. 3.5–3.7 | pH unadj. 3.5–3.7 |

NOTE: pH was adjusted with 25% NaOH

EXAMPLE 1

The following table demonstrates the excellent stability obtained in the formulation. For example, no loss in H202 was observed after 12 weeks at room temperature and only 0.1% $H_2O$ was lost during the 12 week period at 49° C. (120° F.) based upon an initial concentration of 2.1% hydrogen peroxide. Stability was determined by titratiometric techniques and general observation of physical characteristics with time and temperature.

TABLE II

| Formula-tion No. | Initial % $H_2O_2$ | pH | Room Temp. (21° C.) | 40.5° C. (104° F.) | Δ | 49° C. (120° F.) | Δ |
|---|---|---|---|---|---|---|---|
| 2 | 2.1 | 5.94 | 2.1 | 2.1 | | 2.1 | −0.1 |
| 3 | 1.1 | 5.57 | 1.1 | 1.09 | −0.01 | 1.0 | −0.1 |
| 4 | 0.5 | 5.48 | 0.5 | 0.49 | −0.01 | 0.4 | −0.1 |
| 5 | 2.2 | 5.86 | 2.1–0.1 | 2.1 | −0.1 | 2.1 | −0.1 |
| 6 | 1.1 | 5.82 | 1.1 | 1.1 | | 1.0 | −0.1 |
| 7 | 0.5 | 5.87 | 0.5 | 0.5 | 0.5 | | 0.5 |
| 8 | 2.3 | 3.5 | 2.1 | 2.0 | | 1.9 | −0.40 |
| 9 | 1.1 | 3.5 | 1.1 | 0.99 | | 0.8 | −0.30 |
| 10 | 0.5 | 3.5 | 0.5 | 0.47 | | 0.36 | −0.14 |

EXAMPLE 2

Efficacy—Deodorization

The additional deodorizing capability obtained by adding hydrogen peroxide to Resolve was demonstrated by screening effectiveness against tobacco odors on carpeting. Carpet swatches were odorized by being held in close proximity to burning cigarettes until a clearly defined residual odor was obtained. These swatches were then cleaned with and without peroxide and evaluated by an expert panel. The evaluation consisted of panelists smelling carpet swatches and judging odor remaining.

Results clearly indicated that the peroxide formulation was more effective than formulations without hydrogen peroxide. Odor was completely removed, while the non-peroxide product left a noticeable unpleasant odor.

TABLE III

| PANELIST | FORMULATION 8 WITH 2% $H_2O_2$ | FORMULATION 8 WITHOUT $H_2O_2$ |
|---|---|---|
| 1 | almost complete odor removed | slight odor removal |
| 2 | almost complete odor removed | slight odor removal |
| 3 | almost complete odor removed | slight odor removal |
| 4 | almost complete odor removed | slight odor removal |
| 5 | almost complete odor removed | slight odor removal |
| 6 | almost complete odor removed | slight odor removal |
| 7 | almost complete odor removed | slight odor removal |
| 8 | almost complete odor removed | slight odor removal |

EXAMPLE 3

Efficacy—Stain Removal

A wide variety of stains were cleaned with formulations with and without peroxide. The test comparisons were run by equivalent scrubbings (e.g., 60). In all cases, the peroxide formula removed stains as well as the non peroxide formula, and on certain troublesome stains, a dramatically superior cleaning efficacy was noted. The particular stains removed significantly better were blue ink and tomato sauce after being set for one hour and coffee and chocolate after a 24 hour setting time.

The results are contained in the following table: (Ratings: 1-no removal, 5-complete removal)

TABLE IV

| | Blue Ink | Tomato Sauce | Mustard | Chocolate Syrup | Cola | Coffee | Grape Juice | Total |
|---|---|---|---|---|---|---|---|---|
| | | | ONE HOUR SET TIME: | | | | | |
| Formulation 1 (with TEA[1] soap, no Peroxide) | 1.0 | 3.0 | 1.0 | 2.0 | 5.0 | 4.5 | 4.5 | 21 |
| Formulation 2 (with no TEA soap, and 2.0 H2O2) | 4.5 | 4.0 | 1.0 | 2.0 | 5.0 | 4.5 | 4.5 | 25.5 |
| | | | 24 HOUR SET TIME: | | | | | |
| Formulation 2 (without H2O2) | 4.5 | 1.5 | 1.0 | 1.0 | 5.0 | 2.5 | 4.5 | 20 |
| Formulation 2 (with % H2O2) | 4.0 | 1.5 | 1.0 | 5.0 | 5.0 | 4.5 | 5.0 | 26 |

[1]TEA soap is Triethanol Amine Soap

EXAMPLE 4

Efficacy—Redeposition/Resoiling

Carpet swatches treated with formulations with and without peroxide were examined for resoiling characteristics by a laboratory test which simulates build-up of soil by traffic walking over the carpet.

No additive resoiling tendencies were observed by the addition of peroxide to the control formulation.

EXAMPLE 5

Dye Bleeding and Fading

In order to test for possible deleterious effects of the peroxide containing formulation on dyes, cloth test swatches with a sensitive red dye were cleaned with formulation with and without peroxide. A tap water control was also included.

This treatment bleached out a small amount of dye with both formulations, but no additional attack was seen by the peroxide containing formulation, thus demonstrating dye safety.

TABLE V

| Formulation | Red Fabric 100% Cotton | Red Fabric 50% Cotton/ 50% Poly(what) |
|---|---|---|
| 1 | slight fading | no visible difference |
| 6 | slight fading | no visible difference |
| 7 | slight fading | no visible difference |
| Control[1] | slight fading | no visible difference |

[1]Control formulation is a production sample without peroxide and containing triethanolamine oleate.

1 control formulation is a production sample without peroxide and containing triethanolamine oleate.

EXAMPLE 6

The stability of 2.0% (by wt.) H202 in current Formulation 11, below, was acceptable. Tabulated below are the results of their four week stability tests.

| | Initial | Four weeks 75° F. | 105° F. | 120° F. | 37° F. |
|---|---|---|---|---|---|
| Percent $H_2O_2$ | 2.02 | 2.01 | 2.05 | 1.97 | 1.96 |

-continued

| | Initial | Four weeks | | | |
|---|---|---|---|---|---|
| | | 75° F. | 105° F. | 120° F. | 37° F. |
| pH @ 25° F. | 4.0 | 3.6 | 3.4 | 3.4 | 3.7 |

Grape stain removal by formulation 11 is shown in the following table.

| | Grape Stain Removal | |
|---|---|---|
| | Non Stain Resistant Carpet | Stain Resistant Carpet |
| Formulation 11 without $H_2O_2$ | 2.0 | 1.6 |
| Formulation 11 with 2.0% $H_2O_2$ | 1.0 | 1.4 |

NOTE: Average of 10 panelists, visual (1 = best, 2 = worst)

| Formulation 11 Composition: | |
|---|---|
| Ingredient | % by Weight |
| Water, tap (200 ppm hardness maximum | 94.997 |
| Tetrasodium Ethylenediamine Tetraacetate (38%) | 0.25 |
| Detergent Concentrate (Sipex 108) | 1.00 |
| Isopropyl Alcohol - Anhydrous | 1.50 |
| Propylene Glycol Monomethyl Ether | 1.00 |
| Citric Acid | 0.023 |
| Fluorinated Surfactant (Zonyl 6885) | 0.50 |
| Citrus Forest Fragrance 86-975 | 0.50 |
| Formalin (36% Formaldehyde) | 0.20 |
| Kathon CG/ICP | 0.03 |
| | 100.00% |

The invention has been described in detail with particular reference to preferred embodiments thereof, but it will be understood that variations and modifications can be effected within the spirit and scope of the invention.

What is claimed is:

1. A carpet cleaning composition consisting of:
   a. on a weight-to-weight basis of about 0.30 to 2.2 percent of hydrogen peroxide;
   b. from about 0.05 to about 5.0 percent of a nonionic, anionic or amphoteric surfactant or mixtures thereof;
   c. a pH in the range above 4.0 and below 6.4; and
   d. from about 0.07 to about 1.8 percent of a mixture of (i) α--w-fluoropoly-(difluoromethylene) lithium salt of the general formula F(CF2)n-CH2CH2-S-CH2CM2-COOLi (I) , where n is 6 to 12, and (ii) the diethanolamine salt of a perfluoroalkyl phosphate represented by the general formula:

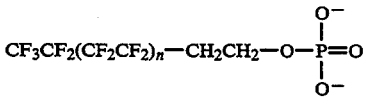

(II)

mono/bis-diethanolamine salt where n is 6 to 12;

wherein the weight ratio of (i) to (ii) is from about 1:1 to about 1:2.

2. A composition according to claim 1 wherein the surfactant is present in an amount of from 0.1 to about 2.0 percent.

3. A composition according to claim 1 wherein the surfactant is present in an amount of from 0.1 to about 2.0 percent.

4. A composition according to claim 1 wherein the mixture described in d. is present in an amount of from about 0.1 to about 0.5 percent by weight of the mixture.

5. A carpet cleaning composition consisting of:
   a. on a weight-to-weight basis of about 0.30 to 2.2 percent of hydrogen peroxide;
   b. from about 0.05 to about 5.0 percent of a nonionic, anionic or amphoteric surfactant or mixtures thereof;
   c. a pH in the range above 4.0 and below 6.4;
   d. from about 0.07 to about 1.8 percent of a mixture of (i) α--w-fluoropoly-(difluoromethylene) lithium salt of the general formula F(CF2)n-CH2CH2-S-CH2CH2-COOLi(I), where n is 6 to 12, and (ii) the diethanolamine salt of a perfluoroalkyl phosphate represented by the general formula:

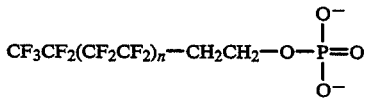

(II)

mono/bis-diethanolamine salt where n is 6 to 12;

wherein the weight ratio of (i) to (ii) is from about 171 to about 1:2; and e. about 1.27 percent of an organic liquid solvent for water-soluble stains in carpet selected from the group consisting from monohydric aliphatic alcohols having 1 to 6 carbon atom, 6. A carpet cleaning composition consisting of:
   a. on a weight-to-weight basis of about 0.30 to 2.2 percent of hydrogen peroxide;
   b. from about 0.05 to about 5.0 percent of a nonionic, anionic or amphoteric surfactant or mixtures thereof;
   c. a pH in the range above 4.0 and below 6.4;
   d. from about 0.07 to about 1.8 percent of a mixture of (i) α--w-fluoropoly-(difluoromethylene) lithium salt of the general formula F(CF2)n-CH2CH2-S-CH2CH2-COOLi(I), where n is 6 to 12, and (ii) the diethanolamine salt of a perfluoroalkyl phosphate represented by the general formula:

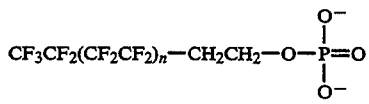

(II)

mono/bis-diethanolamine salt where n is 6 to 12;

wherein the weight ratio of (i) to (ii) is from about 1:1 to about 1:2;

e. about 1.27 percent of an organic liquid solvent for water-soluble stains in carpet selected from the group consisting from monohydric aliphatic alcohols having 1 to 6 carbon atoms; and
   f. about 2.5 percent of solvents for the removal of oily and greasy stains from carpets selected from light aliphatic hydrocarbons and mixtures thereof.

7. A carpet cleaning composition having a pH in the range above 4.0 and below 6.4 comprising:
   (i) on a weight-to-weight basis of about 0.30 to 2.2 percent of hydrogen peroxide;

(ii) from about 0.05 to about 0.075 of a α--w-fluoropoly(difluoromethylene) lithium salt of the general formula F(CF2)n-CH2CH2-S-CH2CH2-COOLi(I), where n is 6 to 12, (iii) from about 0.075 to about 0.1 of diethanolamine salt of a perfluoroalkyl phosphate represented by the general formula:

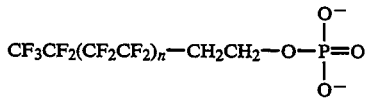

(II)

mono/bis-diethanolamine salt where n is 6 to 12;

(iv) about 0.205 wt-% sodium lauryl sulfate;

(v) about 0.045 wt-% disodium monolauryl sulfosuccinate;

(vi) about 0.095 wt-% tetrasodium ethylenediaminetetraacetate;

(vii) about 0.023 wt-% citric acid;

(viii) about 1.5 wt-% isopropyl alcohol; and (ix) about 1 wt-% propylene glycol monomethyl ether.

* * * * *